United States Patent [19]

Kleefeldt et al.

[11] Patent Number: 4,900,074

[45] Date of Patent: Feb. 13, 1990

[54] MOTOR-VEHICLE DOOR LATCH WITH CHILD-SAFETY CUTOUT

[75] Inventors: Frank Kleefeldt, Heiligenhaus; Johannes T. Menke, Velbert, both of Fed. Rep. of Germany

[73] Assignee: Kiekert GmbH & Co. Kommanditgesellschaft, Heiligenhaus, Fed. Rep. of Germany

[21] Appl. No.: 351,623

[22] Filed: May 12, 1989

[30] Foreign Application Priority Data

Jul. 20, 1988 [DE] Fed. Rep. of Germany ..... 8809256

[51] Int. Cl.[4] ..... E05C 3/26

[52] U.S. Cl. ..... 292/216; 292/DIG. 65; 292/336.3

[58] Field of Search ..... 292/216, 280, DIG. 3, 292/DIG. 26, DIG. 65, 336.3

[56] References Cited

U.S. PATENT DOCUMENTS

| | | | |
|---|---|---|---|
| 3,098,671 | 7/1963 | Moss | 292/221 |
| 3,111,339 | 11/1963 | Nadeau | 292/DIG. 65 X |
| 3,501,189 | 3/1970 | Vila | 292/DIG. 65 X |
| 4,194,377 | 3/1980 | Maeda | 292/216 X |
| 4,487,441 | 12/1984 | Miyamoto et al. | 292/DIG. 65 X |

FOREIGN PATENT DOCUMENTS

| | | |
|---|---|---|
| 3235891 | 4/1983 | Fed. Rep. of Germany . |
| 1165142 | 9/1969 | United Kingdom . |

*Primary Examiner*—Richard E. Moore

*Attorney, Agent, or Firm*—Herbert Dubno; Andrew Wilford

[57] ABSTRACT

A standard motor-vehicle door latch includes a latch housing adapted to be secured to a motor-vehicle door adjacent an edge thereof that is substantially only exposed when the door is open, an opening lever adapted to be coupled to an inside door handle and pivoted on the housing, and door opening mechanism on the housing actuatable by the lever to unlatch the door. A child-safety cutout comprises a shaft pivotal in the housing between a freeing position and a locking position and having an outer end exposed through the housing at the door edge and an inner end and an element on the inner end operatively engageable with the opening lever for preventing actuation of the door-opening mechanism by the opening lever in the locking position and for permitting such actuation in the freeing position.

6 Claims, 3 Drawing Sheets

MOTOR-VEHICLE DOOR LATCH WITH CHILD-SAFETY CUTOUT

FIELD OF THE INVENTION

The present invention relates to a motor-vehicle door latch. More particularly this invention concerns such a door latch provided with a mechanism that can disable the inside door handle for the protection of children in the vehicle.

BACKGROUND OF THE INVENTION

It is standard as described in U.S. Pat. No. 3,098,671 of Moss, British patent No. 1,165,142 of Greenland, and German patent document No. 3,235,891 (based on Japanese P No. 56 153064 filed Sept. 29, 1989) of Miyamoto to provide a motor-vehicle door latch with a cutout that makes it impossible to open the door using the inside door handle and normally also to lock the door from the inside. Such a latch is typically provided on the rear doors so that a child cannot open the door and fall out or lock himself in the vehicle.

Typically the element that sets the child-safety cutout in the freeing or locking position is a lever that projects through or is exposed at a slot in the edge of the door. This slot is big enough to allow the lever to be shifted between its two positions and, therefore, constitutes a substantial opening into which water and dirt can get. In addition the projecting lever is easily actuated so that it can inadvertently or accidentally be set in the wrong position.

OBJECTS OF THE INVENTION

It is therefore an object of the present invention to provide an improved child-safety cutout for a motor-vehicle door latch.

Another object is the provision of such an improved child-safety cutout for a motor-vehicle door latch which overcomes the above-given disadvantages, that is which does not require that the vehicle door be left with a hard-to-seal hole and that cannot be actuated inadvertently.

SUMMARY OF THE INVENTION

These objects are attained in a standard motor-vehicle door latch including a latch housing adapted to be secured to a motor-vehicle door adjacent an edge thereof that is substantially only exposed when the door is open, an opening lever adapted to be coupled to an inside door handle and pivoted on the housing, and door opening mechanism on the housing actuatable by the lever to unlatch the door. The child-safety cutout according to this invention comprises a shaft pivotal in the housing between a freeing position and a locking position and having an outer end exposed through the housing at the door edge and an inner end and an element on the inner end operatively engageable with the opening lever for preventing actuation of the door-opening mechanism by the opening lever in the locking position and for permitting such actuation in the freeing position.

Thus with the system of this invention the child-safety cutout is mounted not in the side plate of the door but in the edge thereof so that it is not necessary to provide a separate hole through which to actuate it. The rotary shaft can easily be tightly sealed relative to the latch housing, completely excluding moisture and dirt from entering the latch at this location.

According to this invention the latch housing is formed with a bolt-receiving recess and is provided with a fork engageable in the recess with a doorpost-mounted bolt to secure the door shut, the outer end being exposed in the recess. The element on the inner shaft end can be an eccentric engageable with the lever to block pivoting of same in the locking position only or it can be a link that couples the lever to the mechanism in the freeing position and that decouples the lever from the mechanism in the locking position.

In accordance with a further feature of this invention the outer shaft end is formed with a tool-receiving seat so that a tool can be inserted into the seat to rotate the shaft between its positions. The housing is formed with a port through which the outer shaft end projects and in which it fits snugly. The outer shaft end is flush on the outside with the housing. Thus accidental actuation is virtually impossible, yet when the seat is a simple screwdriver slot it is a simple matter to change the setting.

DESCRIPTION OF THE DRAWING

The above and other objects, features, and advantages will become more readily apparent from the following, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing.

SPECIFIC DESCRIPTION

Figure 1:
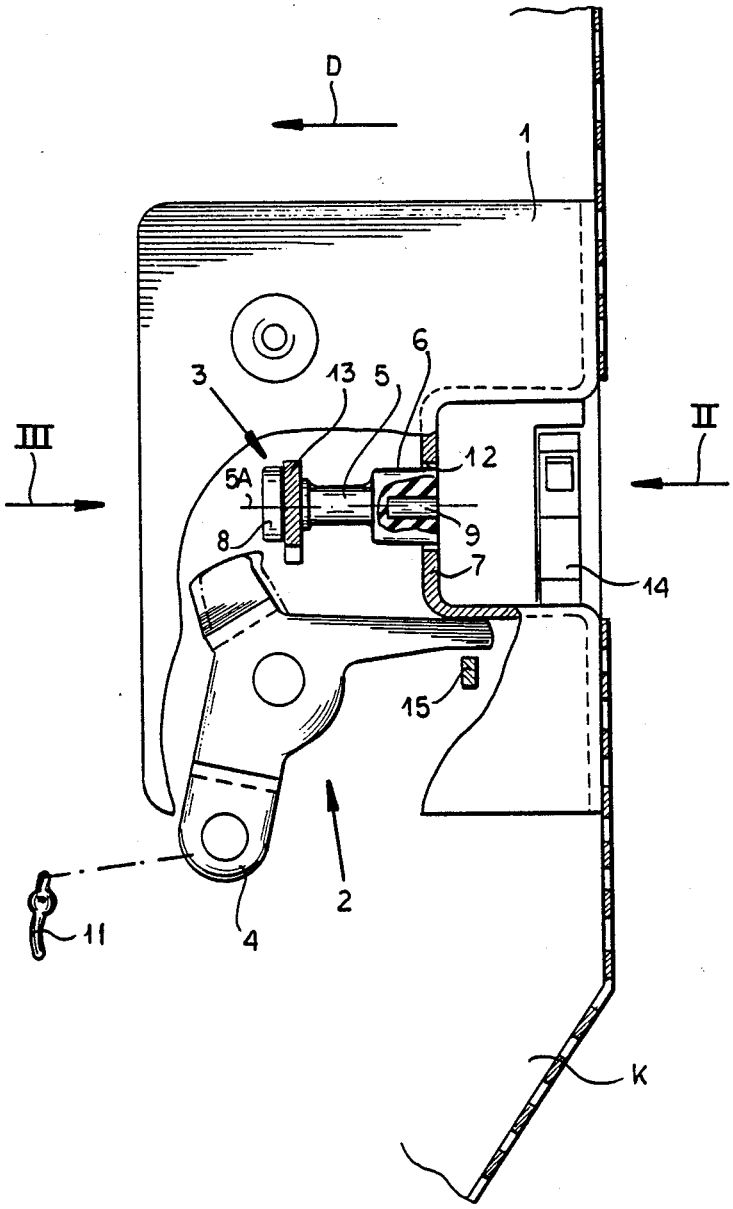
FIG. 1 is a partly diagrammatic vertical longitudinal section through a motor-vehicle door and door latch according to this invention seen from inside the vehicle.

As seen in FIGS. 1 through three a door K of a motor vehicle that normally travels in a direction D has an edge fitted with a latch plate or housing 1 in which is mounted a pivotal lever 2 having an arm 4 connected to an inside door handle 11. The housing 1 is also provided with a child-safety cutout 3 that is to be operated when the door K is open, that is when access can be had to the door edge that is covered up when the door is closed.

Figure 3:
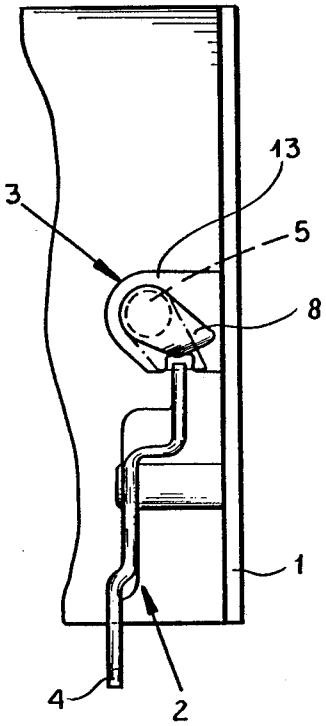
FIGS. 2 and 3 are longitudinal end views taken in the direction of arrows II and III, respectively, of FIG. 1.
Figure 2:
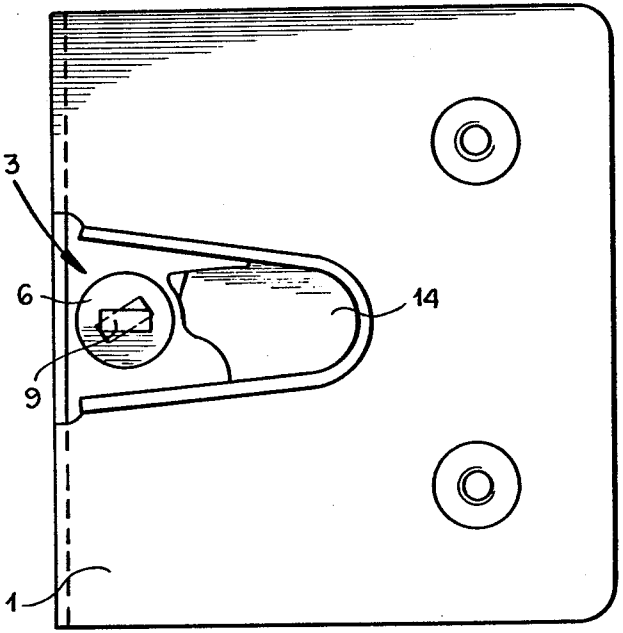

The safety cutout 3 is constituted as a shaft 5 rotatable about an axis 5A parallel to the direction D and having a head 6 exposed in a complementary port 12 formed in the bolt-receiving U-shaped inset 7 of the plate 1. The shaft is journaled on its inner end in a transverse tab 13 of the housing 1 and carries on its inner end an eccentric pawl 8 engageable with the lever 2 to block same, and is formed on its head 6 with a recess 9, here a straight slot diametrally crossing the axis 5A and shaped to receive the tip of a screwdriver. The freeing position is shown in FIG. 3 and in dot-dash likes in FIG. 2. Here the pawl 8 blocks actuation of the lever 2 in the locking position and prevents it from operating a lock mechanism whose principal element is a fork 14 operable by a lever 15 and adapted to engage around a bolt projecting from the doorpost and receiveable in the cutout 11.

Figure 4:
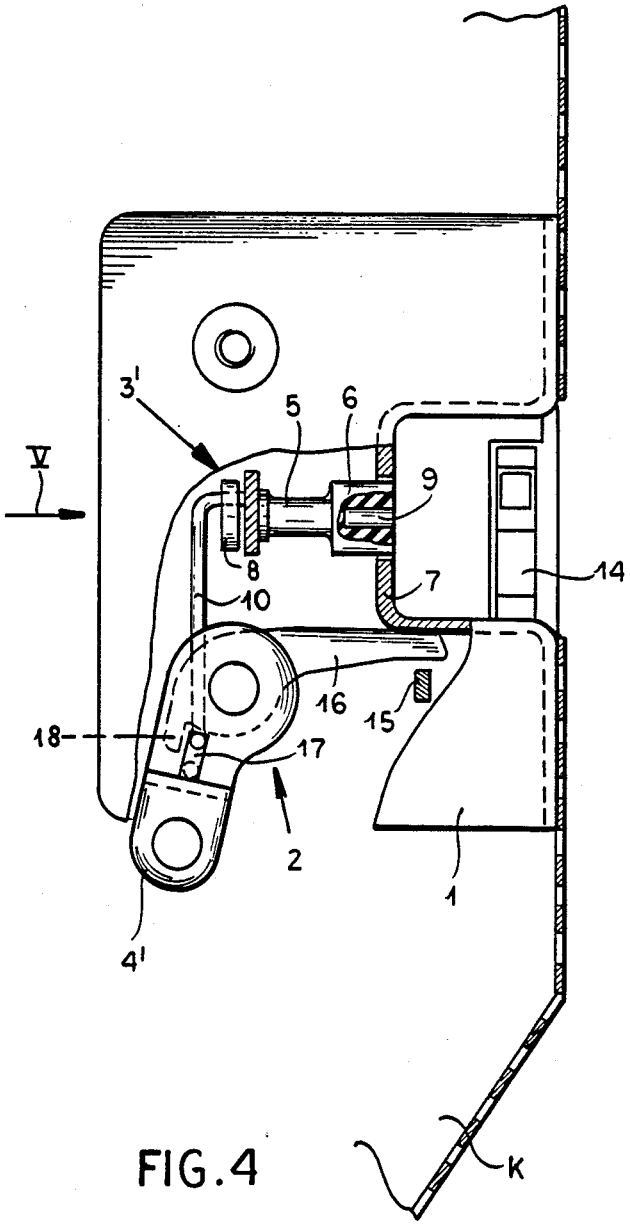
FIG. 4 is a view like FIG. 1 of another latch according to this invention.
Figure 5:
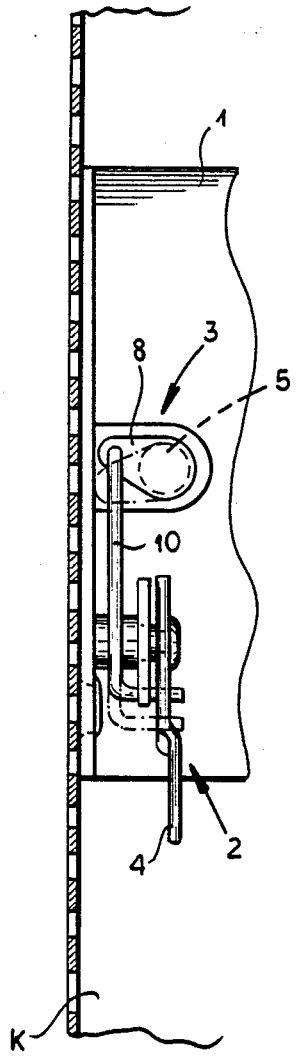
FIG. 5 is an end view taken in the direction of arrow V of FIG. 4.

FIGS. 4 and 5 show an arrangement wherein the safety cutout 3' serves to uncouple the lever 4' from another lever 16 that in turn acts on the fork-operating lever 15. To this end the inner end of the shaft 4 is attached offcenter to a link rod 10 whose other end is slidable in a slot 17 in the lever 4' between a position engageable with a tab 18 of the lever 16 and a position unengageable therewith. When the link 10 is lifted a clockwise rotation of the lever 4' will be transmitted via the rod 10 to the lever 16 and thence to the lever 15 to release the fork 14. When the link 10 is down pivoting of the lever 4' will not be transmitted to the levers 15 and 16.

We claim:

1. In a motor-vehicle door latch including:

a latch housing adapted to be secured to a motor-vehicle door adjacent an edge thereof that is substantially only exposed when the door is open;

an opening lever adapted to be coupled to an inside door handle and pivoted on the housing; and door opening mechanism on the housing actuatable by the lever to unlatch the door, a child-safety cutout comprising:

a shaft pivotal in the housing between a freeing position and a locking position and having an outer end exposed through the housing at the door edge and an inner end; and means including an element on the inner end operatively engageable with the opening lever for preventing actuation of the door-opening mechanism by the opening lever in the locking position and for permitting such actuation in the freeing position.

2. The door latch defined in claim 1 wherein the latch housing is formed with a bolt-receiving recess and is provided with a fork engageable in the recess with a doorpost-mounted bolt to secure the door shut, the outer end being exposed in the recess.

3. The door latch defined in claim 1 wherein the element on the inner shaft end is an eccentric engageable with the lever to block pivoting of same in the locking position only.

4. The door latch defined in claim 1 wherein the outer shaft end is formed with a tool-receiving seat, whereby a tool can be inserted into the seat to rotate the shaft between its positions.

5. The door latch defined in claim 1 wherein the element on the inner shaft end is a link that couples the lever to the mechanism in the freeing position and that decouples the lever from the mechanism in the locking position.

6. The door latch defined in claim 1 wherein the housing is formed with a port through which the outer shaft end projects and in which it fits snugly, the outer shaft end being flush on the outside with the housing.

* * * * *